US009957982B2

(12) United States Patent
Ueda et al.

(10) Patent No.: US 9,957,982 B2
(45) Date of Patent: May 1, 2018

(54) LIFTING DEVICE

(71) Applicant: KABUSHIKI KAISHA TOYOTA JIDOSHOKKI, Kariya-shi, Aichi-ken (JP)

(72) Inventors: Yuki Ueda, Kariya (JP); Tsutomu Matsuo, Kariya (JP); Hirohiko Ishikawa, Kariya (JP)

(73) Assignee: KABUSHIKI KAISHA TOYOTA JIDOSHOKKI, Kariya-Shi, Aichi-Ken (JP)

( * ) Notice: Subject to any disclaimer, the term of this patent is extended or adjusted under 35 U.S.C. 154(b) by 407 days.

(21) Appl. No.: 14/436,263

(22) PCT Filed: Oct. 18, 2012

(86) PCT No.: PCT/JP2012/076915

§ 371 (c)(1),
(2) Date: Apr. 16, 2015

(87) PCT Pub. No.: WO2014/061125

PCT Pub. Date: Apr. 24, 2014

(65) Prior Publication Data

US 2015/0300380 A1 Oct. 22, 2015

(51) Int. Cl.
*F15B 11/04* (2006.01)
*B66F 9/22* (2006.01)

(52) U.S. Cl.
CPC ..... *F15B 11/0413* (2013.01); *B66F 9/22* (2013.01); *F15B 2211/20569* (2013.01); *F15B 2211/3057* (2013.01); *F15B 2211/30505* (2013.01); *F15B 2211/30515* (2013.01); *F15B 2211/353* (2013.01); *F15B 2211/355* (2013.01); *F15B 2211/46* (2013.01); *F15B 2211/473* (2013.01); *F15B 2211/8606* (2013.01)

(58) Field of Classification Search
CPC ..... F15B 11/04; F15B 11/0413; F15B 2211/20569; F15B 2211/30505
USPC ..... 91/451, 450
See application file for complete search history.

(56) References Cited

FOREIGN PATENT DOCUMENTS

JP 05-49799 U 6/1993
JP 07-257899 A 10/1995
(Continued)

OTHER PUBLICATIONS

International Preliminary Report on Patentability dated Apr. 21, 2015, issued by the International Searching Authority in counterpart Application No. PCT/JP2012/076915.
(Continued)

*Primary Examiner* — F. Daniel Lopez
*Assistant Examiner* — Daniel Collins
(74) *Attorney, Agent, or Firm* — Sughrue Mion, PLLC

(57) ABSTRACT

An electromagnetic switching valve, for which the maximum opening is set to be small, is disposed on piping between a lift cylinder and a hydraulic pump motor. A pilot check valve, for which the maximum opening is set to be larger than the electromagnetic switching valve, is disposed on piping, different from the piping, between the lift cylinder and the hydraulic pump motor. In addition, during lowering operations, first, the electromagnetic switching valve is opened, and then after the same is opened, the pilot check valve is opened after a prescribed time has passed. Thus, the shock generated when lowering an object to be raised/lowered is reduced and a fork is operated quickly.

6 Claims, 3 Drawing Sheets

(56) References Cited

FOREIGN PATENT DOCUMENTS

| | | | |
|---|---|---|---|
| JP | 2008-007258 | A | 1/2008 |
| JP | 2008-156082 | A | 7/2008 |

OTHER PUBLICATIONS

International Search Report of PCT/JP2012/076915 dated Mar. 5, 2013.

LIFTING DEVICE

CROSS REFERENCE TO RELATED APPLICATIONS

This is a National Stage of International Application No. PCT/JP2012/076915 filed Oct. 18, 2012, the contents of which are incorporated herein by reference in its entirety.

TECHNICAL FIELD

The present invention relates to a lifting device that includes a hydraulic cylinder used for lifting and lowering and hydraulically drives the hydraulic cylinder to lift and lower a lifting material.

BACKGROUND ART

A lifting device may hydraulically drive a hydraulic cylinder to lift and lower a lifting material. For example, patent document 1 describes such a known lifting device that is used for a forklift. A lifting device for a forklift lifts and lowers a fork (material handler), which serves as a lifting material, by supplying and discharging hydraulic oil to and from a hydraulic cylinder. This type of a lifting device includes a switch valve that controls the hydraulic oil flowing to a hydraulic pipe arranged between a hydraulic cylinder and the hydraulic pump. The fork is lifted, lowered, or stopped by controlling the opening and closing of the switch valve.

However, the switch valve may have different pressures at an inflow side and an outflow side of the hydraulic oil. Under this condition, if the lifting device for a forklift opens the switch valve to lower the fork, a shock would occur when the hydraulic oil starts flowing. Such a shock leads to unstable operation of the fork, which would move a carried cargo.

The lifting device of patent document 1 includes a means for solving the above problem. More specifically, the lifting device of patent document 1 temporarily activates the hydraulic pump to lift the fork when starting a lowering operation to decrease the pressure difference.

PRIOR ART DOCUMENT

Patent Document

Patent Document 1: Japanese Laid-Open Patent Publication No. 2008-7258

SUMMARY OF THE INVENTION

When starting the present lowering operation, the lifting device of patent document 1 determines, from the time elapsed from when the preceding lowering operation ended and the pressure of the cylinder, how fast and how long the hydraulic pump produces rotation in a lifting direction. The lifting device of patent document 1 may obtain a value taken when the cylinder pressure is pulsating. In such a case, the increased pressure may be excessive or insufficient. When the increase in the pressure is excessive, the hydraulic cylinder performs a lifting operation. From this condition, the lowering operation is performed. This generates a time lag between when the lowering operation is instructed and when the lowering operation actually starts. When the increase in the pressure is insufficient, the hydraulic cylinder performs a lowering operation without decreasing the pressure difference. This generates a shock when the hydraulic oil starts flowing.

It is an object of the present invention to provide a lifting device that may be readily operated and reduces the shock that may occur when a lifting material is lowered.

To achieve the above object, one aspect of the present invention is a lifting device that lifts and lowers a lifting material by supplying and discharging hydraulic oil to and from a hydraulic cylinder. The lifting device includes a hydraulic pump that supplies the hydraulic oil to the hydraulic cylinder, a first oil passage that connects the hydraulic cylinder and the hydraulic pump, a second oil passage that connects the hydraulic cylinder and the hydraulic pump, and an opening-closing unit that opens and closes the first oil passage and the second oil passage. The first oil passage has a maximum oil passage area that is smaller than a maximum oil passage area of the second oil passage. The first oil passage includes a first portion between the hydraulic cylinder and the opening-closing unit and a second portion between the opening-closing unit and the hydraulic pump. The opening-closing unit allows the hydraulic oil to flow through the first oil passage when the lifting material is lowered. After the first oil passage opens, the opening-closing unit allows the hydraulic oil to flow through the second oil passage when a first pressure difference between the first portion and the second portion decreases to a predetermined pressure difference or less.

In the above structure, the first oil passage, which has the small maximum oil passage area, connects first during a lowering operation. Since the maximum oil passage area of the first oil passage is small, a flow rate of the hydraulic oil flowing to the oil passage is limited. Thus, the hydraulic oil does not suddenly start flowing. Connection of the first oil passage decreases the pressure difference between the hydraulic cylinder and the hydraulic pump (first pressure difference between the first portion and the second portion). After the first oil passage opens, when the second oil passage, which has the large maximum oil passage area, opens, the pressure difference has been already decreased between the hydraulic cylinder and the hydraulic pump. This limits generation of a shock even when the hydraulic oil suddenly flows, thereby decreasing a shock that may occur when lowering the lifting material. Additionally, when the lowering operation starts, the hydraulic pump is not controlled to perform lifting operation. This minimizes the time lag from when a lowering operation is instructed to when the lowering operation is actually performed. Consequently, the lifting material may be promptly operated.

Preferably, the opening-closing unit includes a first direction control valve arranged in the first oil passage and a second direction control valve arranged in the second oil passage. The first direction control valve switches a flow direction of the hydraulic oil in the first oil passage. The second direction control valve switches a flow direction of the hydraulic oil in the second oil passage. The maximum oil passage area of the first oil passage is determined by a maximum open degree of the first direction control valve. The maximum oil passage area of the second oil passage is determined by a maximum open degree of the second direction control valve. The maximum open degree of the first direction control valve is smaller than the maximum open degree of the second direction control valve.

In the above structure, the opening-closing unit includes the first direction control valve, which has the small maximum open degree, and the second direction control valve. The maximum open degree of the second direction control valve is larger than the maximum open degree of the first direction control valve. After the first direction control valve opens, the second direction control valve opens. Thus, a simple structure may be used to promptly operate the lifting operation while decreasing a shock that may occur when lowering the lifting material.

Preferably, the hydraulic oil flows from the hydraulic cylinder toward the hydraulic pump through the first and second oil passages when the first direction control valve and the second direction control valve open, thereby causing the hydraulic oil to function as driving power used for driving the hydraulic pump as a hydraulic motor so that the hydraulic motor performs a regeneration operation.

In the above structure, electric energy may be efficiently used resulting from the regeneration operation of the lowering operation. The maximum open degree of the second direction control valve is large. Thus, the pressure drop is small when the hydraulic oil passes through the second direction control valve. This provides a sufficient torque used for rotating the hydraulic pump as the hydraulic motor. Consequently, electric energy may be efficiently obtained from the regeneration operation.

Preferably, the maximum open degree of the second direction control valve is set to be in a range of 20 to 50 times larger than the maximum open degree of the first direction control valve.

In the above structure, the difference in the maximum open degree between the first direction control valve and the second direction control valve is large. This allows a prompt operation while decreasing a shock that may occur when lowering the lifting material by controlling the timing for opening the first direction control valve and the second direction control valve without proportionally controlling open degrees of the valves.

Preferably, the lifting device further includes a measurement unit that measures a time elapsed from when the first direction control valve opens. The opening-closing unit opens the second direction control valve when the elapsed time reaches a predetermined time.

In the above structure, the timing for opening the second direction control valve is managed based on time. Thus, the control may be simplified.

Preferably, the lifting device further includes a third oil passage, through which the hydraulic oil that has passed through the second direction control valve flows, and a switch valve arranged in the third oil passage. The first direction control valve is an electromagnetic switch valve. The second direction control valve is a pilot check valve including a valve body accommodated in the second direction control valve and a throttle oil passage formed in the valve body. The opening-closing unit is configured to open the switch valve. When the switch valve opens, the hydraulic oil is discharged from the hydraulic cylinder to the third oil passage through the throttle oil passage, which generates a second pressure difference between an inflow side and an outflow side of the throttle oil passage. The valve body moves in a direction in which the second oil passage opens in accordance with the second pressure difference.

In the above structure, the electromagnetic switch valve of the third oil passage is a means for applying the pilot pressure to the pilot check valve. This limits an enlargement of the device and an increase in costs compared to when an electromagnetic switch valve having a large maximum open degree is employed instead of the pilot check valve.

Effects of the Invention

The present invention performs a prompt operation while decreasing a shock that may occur when a lifting material is lowered.

DETAILED DESCRIPTION OF THE PREFERRED EMBODIMENTS

First Embodiment

Figure 1:
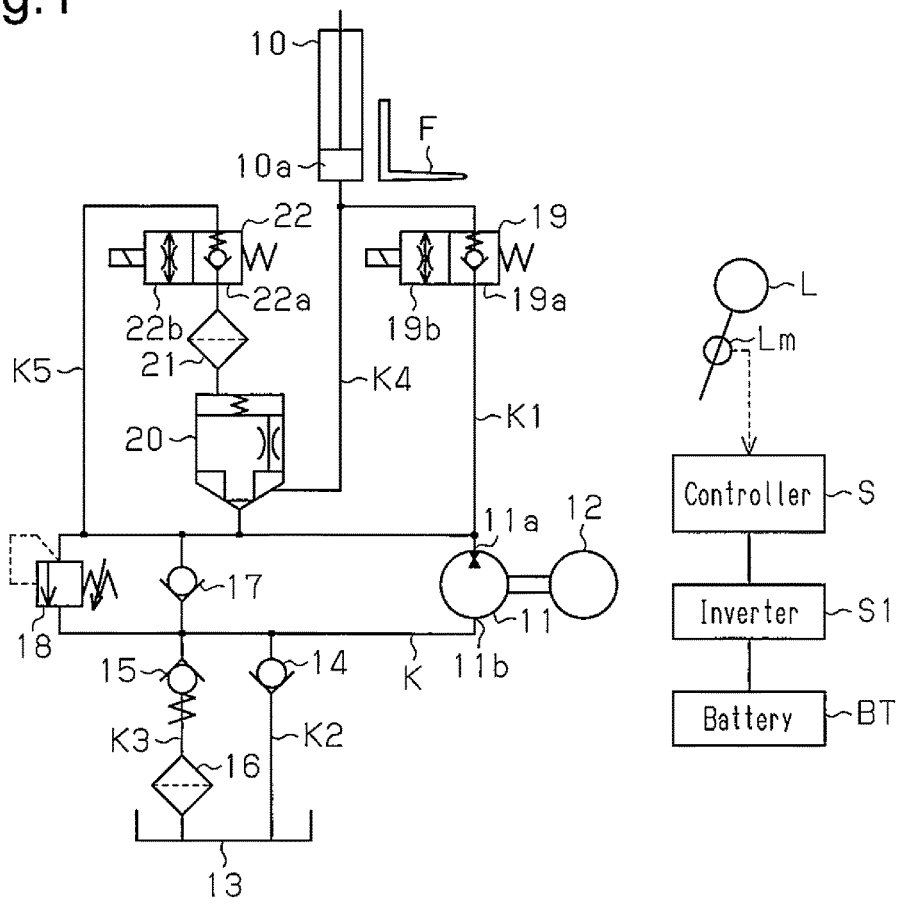
FIG. 1 is a circuit diagram of a first embodiment of a lifting device.
Figure 2:
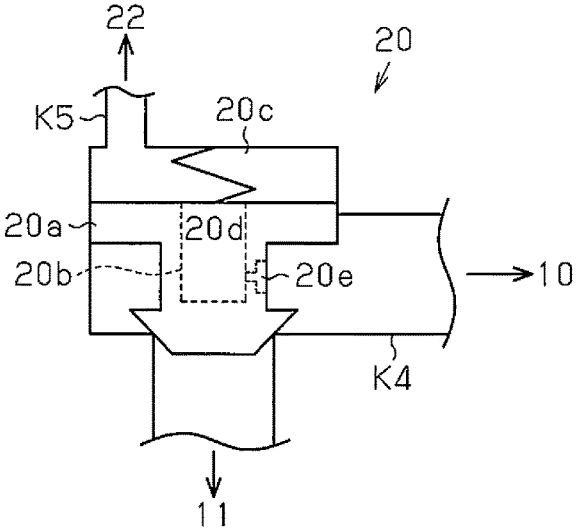
FIG. 2 is a schematic view schematically showing the internal structure of a pilot check valve.

A first embodiment of a lifting device that includes a lift cylinder lifting and lowering a fork of a forklift according to the present invention will now be described with reference to FIGS. 1 to 3.

A fork F is arranged at the front of a forklift and serves as a material handler (lifting material). When a lift lever L arranged in a cab is operated, a lift cylinder 10, which serves as a hydraulic cylinder, is extended or retracted to lift and lower the fork F.

A hydraulic control mechanism used for operating the lift cylinder 10 of the present embodiment will now be described with reference to FIG. 1.

A main pipe K, which has a closed circuit structure, is connected to a hydraulic pump motor 11, which functions as a hydraulic pump and a hydraulic motor. The main pipe K is also connected to a pipe K1, which serves as a first oil passage. The pipe K1 forms a passage through which the hydraulic oil is supplied to and discharged from the lift cylinder 10 and is connected to a bottom chamber 10*a* of the lift cylinder 10. The pipe K1 connects the lift cylinder 10 and the hydraulic pump motor 11. The hydraulic pump motor 11 is configured to be capable of producing rotation in two directions. The main pipe K is connected to transmission openings 11*a*, 11*b* of the hydraulic pump motor 11. The transmission openings 11*a*, 11*b* each serve as an inlet or outlet in accordance with the flow direction of the hydraulic oil.

The hydraulic pump motor 11 is connected to a lift motor 12 (rotational electric device), which functions as an electric motor and an electric generator. The lift motor 12 functions as an electric motor when a coil of a stator (not shown) is energized to rotate a rotor. The lift motor 12 functions as an electric generator when rotation of the rotor generates power in the coil of the stator. The lift motor 12 of the present embodiment functions as an electric motor when activating the hydraulic pump motor 11 as a hydraulic pump, and as an electric generator when activating the hydraulic pump motor 11 as a hydraulic motor.

Additionally, the main pipe K is connected to a supply pipe K2. When the lift cylinder 10 performs a lifting operation, the hydraulic pump motor 11 is activated to draw the hydraulic oil from an oil tank 13 and deliver the hydraulic oil through the supply pipe K2. The supply pipe K2 includes a check valve 14 (non-return valve) that prevents reverse flow from the main pipe K to the oil tank 13. The main pipe K is also connected to a discharge pipe K3. When the lift cylinder 10 performs a lowering operation, the hydraulic pump motor 11 is activated to return the hydraulic oil to the oil tank 13 through the discharge pipe K3. The discharge pipe K3 includes a check valve 15 (non-return valve) that prevents reverse flow from the oil tank 13 to the main pipe K. The discharge pipe K3 includes a filter 16 between the oil tank 13 and the check valve 15.

Additionally, the main pipe K includes a check valve 17 (non-return valve) that prevents reverse flow from the main pipe K, which is connected to the transmission opening 11*a* of the hydraulic pump motor 11, to the main pipe K, which is connected to the transmission opening 11*b* of the hydraulic pump motor 11. The check valve 17 is arranged in an oil passage between the transmission opening 11*a*, which may serve as the outlet of the hydraulic pump motor 11, and the oil tank 13, which stores the hydraulic oil. The check valve 17 allows the hydraulic oil to flow from an oil passage located toward the oil tank 13 from the check valve 17 to the main pipe K located toward the transmission opening 11*b* of the hydraulic pump motor 11 from the check valve 17. The main pipe K also includes a relief valve 18, which prevents an increase in the pressure.

The pipe K1, which is connected to the bottom chamber 10*a* of the lift cylinder 10, includes an electromagnetic switch valve 19. The electromagnetic switch valve 19 serves as a first direction control valve that switches a flow direction of the hydraulic oil flowing in the first oil passage. The electromagnetic switch valve 19 may be shifted between two positions, namely, a first position 19*a* and a second position 19*b*. When a solenoid is not excited, the electromagnetic switch valve 19 of the present embodiment is set at the first position 19*a* and allows the hydraulic oil to flow from the hydraulic pump motor 11 to the lift cylinder 10. When the solenoid is excited, the electromagnetic switch valve 19 of the present embodiment is set at the second position 19*b* and allows the hydraulic oil to bidirectionally flow between the hydraulic pump motor 11 and the lift cylinder 10. The electromagnetic switch valve 19 of the present embodiment is an on-off valve, which adjusts an open degree in accordance with the excitement (on) and non-excitement (off) of the solenoid. Thus, the electromagnetic switch valve 19 of the present embodiment differs from an electromagnetic proportional valve capable of adjusting the open degree in a non-stepped manner. The electromagnetic switch valve 19 of the present embodiment forms an opening-closing unit that opens and closes the pipe K1, which serves as the first oil passage.

Additionally, the present embodiment includes a pipe K4, which serves as a second oil passage, arranged separately from the pipe K1, which serves as the first oil passage. The pipe K4 forms a passage through which the hydraulic oil is supplied to and discharged from the lift cylinder 10 and is connected to the bottom chamber 10*a* of the lift cylinder 10. The pipe K4 connects the lift cylinder 10 and the hydraulic pump motor 11. The pipe K4 includes a pilot check valve 20. The pilot check valve 20 serves as a second direction control valve that switches a flow direction of the hydraulic oil flowing in the second oil passage. As schematically shown in FIG. 2, the pilot check valve 20 of the present embodiment has a structure in which a main body accommodates a valve body 20*a* that includes a throttle oil passage 20*b*. The throttle oil passage 20*b* connects the pipe K4 arranged between the pilot check valve 20 and the bottom chamber 10*a* of the lift cylinder 10 and a spring chamber 20*c* accommodated in the main body. The throttle oil passage 20*b* is formed by a large diameter oil passage 20*d* that opens to the spring chamber 20*c* and a small diameter oil passage 20*e* that extends through from the circumferential surface of the valve body 20*a* toward the large diameter oil passage 20*d*. The small diameter oil passage 20*e* has a small diameter compared to the large diameter oil passage 20*d*.

When the hydraulic pump motor 11 is activated, the hydraulic oil is discharged from the transmission opening 11*a*, which serves as the outlet, and flows through the main pipe K. When receiving the pressure of the hydraulic oil, the valve body 20*a* moves. This opens the pilot check valve 20 and allows the hydraulic oil to flow to a passage located toward the lift cylinder 10 from the pilot check valve 20. When deactivation of the hydraulic pump motor 11 stops the flow of the oil passage, the valve body 20*a* receives an urging force of a spring arranged in the spring chamber 20*c*. This moves the valve body 20*a* and closes the pilot check valve 20, which is open. Additionally, when a difference between the pressure of the pipe K4 located toward the lift cylinder 10 from the pilot check valve 20 and the pressure of the spring chamber 20*c* reaches a predetermined pressure, the valve body 20*a* receives the pressure difference. This moves the valve body 20*a* and opens the pilot check valve 20. The pilot check valve 20, which is open, flows the hydraulic oil discharged from the bottom chamber 10*a* of the lift cylinder 10 to an oil passage located toward the main pipe K (hydraulic pump motor 11) from the pilot check valve 20. More specifically, the pressure difference, which is used as a pressure for moving the valve body 20*a* (pilot pressure), opens the pilot check valve 20. The pilot check valve 20 of the present embodiment forms an opening-closing unit that opens and closes the pipe K4, which serves as the second oil passage.

The spring chamber 20*c* of the pilot check valve 20 is connected to a pipe K5, which serves as a third oil passage. The pipe K5 includes an electromagnetic switch valve 22, which serves as a switch valve, with a filter 21 arranged between the electromagnetic switch valve 22 and the spring chamber 20*c* of the pilot check valve 20. The pipe K5 is connected to the main pipe K that is connected to the transmission opening 11*a* of the hydraulic pump motor 11. The pipe K5 also serves as a return oil passage. More specifically, the hydraulic oil, which flows to the pipe K5 from the pilot check valve 20, passes through the electromagnetic switch valve 22 and returns to the transmission opening 11*a* of the hydraulic pump motor 11 through the main pipe K.

The electromagnetic switch valve 22 may be shifted between two positions, namely, a first position 22*a* and a second position 22*b*. When a solenoid is not excited, the electromagnetic switch valve 22 of the present embodiment is set at the first position 22*a* and allows the hydraulic oil to flow from the pipe K5 to the main pipe K. When the solenoid is excited, the electromagnetic switch valve 22 of the present embodiment is set at the second position 22*b* and allows the hydraulic oil to bidirectionally flow between the pipe K5 and the main pipe K. The electromagnetic switch valve 22 of the present embodiment is an on-off valve, which adjusts an open degree in accordance with the excitement (on) and non-excitement (off) of the solenoid. Thus, the electromagnetic switch valve 22 of the present embodiment differs from an electromagnetic proportional valve capable of adjusting the open degree in a non-stepped manner.

In the present embodiment, the maximum open degrees of the electromagnetic switch valve 19, the pilot check valve 20, and the electromagnetic switch valve 22, are each set as described below. In the description hereafter, the open degree of each of the electromagnetic switch valve 19 and the electromagnetic switch valve 22 become maximal when set at the second positions 19*b*, 22*b*, respectively. The open degree of the pilot check valve 20 is maximal when the valve body 20*a* is open. In the present embodiment, the maximum open degree of the pilot check valve 20 is set to be larger than the maximum open degree of each of the electromagnetic switch valves 19, 22. In other words, the maximum open degree of each of the electromagnetic switch valves 19, 22 is set to be smaller than the maximum open degree of the pilot check valve 20. More specifically, the ratio of the maximum open degree of the electromagnetic switch valve 19 to the maximum open degree of the pilot check valve 20 is set to be in a range of 1:20 to 1:50. That is, the maximum open degree of the pilot check valve 20 is set to be in a range of 20 to 50 times larger than the maximum open degree of the electromagnetic switch valve 19. The open degree of the electromagnetic switch valve 19 is set so that a value indicating a shock that occurs during a lowering operation is below a target value. The maximum open degree of the electromagnetic switch valve 22 is set to be the same as or larger than the maximum open degree of the electromagnetic switch valve 19. In the hydraulic control mechanism of the present embodiment, the maximum open degree of the electromagnetic switch valve 19 corresponds to the maximum oil passage area of the first oil passage. The maximum open degree of the pilot check valve 20 corresponds to the maximum oil passage area of the second oil passage. Thus, the maximum oil passage area of the pipe K1, which includes the electromagnetic switch valve 19 and serves as the first oil passage, is smaller than the maximum oil passage area of the pipe K4, which includes the pilot check valve 20 and serves as the second oil passage.

The structure of a controller S of the hydraulic control mechanism will now be described.

The controller S is electrically connected to a potentiometer Lm that detects the amount of operation of the lift lever L. The controller S controls the rotation speed of the lift motor 12 based on a detection signal from the potentiometer Lm in accordance with the operation amount of the lift lever L. The controller S also controls the open degree of each of the electromagnetic switch valves 19, 22 during lifting and lowering operations.

Additionally, the controller S is electrically connected to an inverter S1. Power is supplied to the lift motor 12 from a battery BT installed in the forklift via the inverter S1. Power generated with the lift motor 12 is stored in the battery BT via the inverter S1. The forklift of the present embodiment is of a battery type that travels by supplying power from the battery BT to a traveling motor, which serves as a motor. In the present embodiment, the controller S functions as an opening-closing unit that opens and closes the first oil passage and the second oil passage by performing open-close control. The controller S also functions as a measurement unit.

The operation of the hydraulic control mechanism of the present embodiment will now be described.

The operation for lifting the fork F will now be described.

When lifting the fork F, the hydraulic oil is supplied to the bottom chamber 10*a* of the lift cylinder 10. Thus, the controller S controls the rotation speeds of the hydraulic pump motor 11 and the lift motor 12 to perform lifting at a speed that is in accordance with the operation amount instructed with the lift lever L. The controller S also sets the electromagnetic switch valves 19, 22 at the first positions 19*a*, 22*a*, respectively. Thus, the hydraulic oil, which is drawn from the oil tank 13 by the hydraulic pump motor 11, flows through the main pipe K to the electromagnetic switch valve 19 and then the bottom chamber 10*a*. That is, the direction in which the hydraulic oil flows is the direction in which the hydraulic oil flows from the oil tank 13 to the electromagnetic switch valve 19 and then from the electromagnetic switch valve 19 to the bottom chamber 10*a* of the lift cylinder 10. The hydraulic oil, which is drawn from the oil tank 13 by the hydraulic pump motor 11, flows to the pilot check valve 20 through the main pipe K. This opens the pilot check valve 20. Consequently, the hydraulic oil flows to the bottom chamber 10*a*. That is, the direction in which the hydraulic oil flows is the direction in which the hydraulic oil flows from the oil tank 13 to the pilot check valve 20 and then from the pilot check valve 20 to the bottom chamber 10*a* of the lift cylinder 10. When the hydraulic oil enters the bottom chamber 10*a*, the lift cylinder 10 is extended. This lifts the fork F. The hydraulic pump motor 11 functions as the hydraulic pump during the lifting operation.

The operation for lowering the fork F will now be described with reference to FIG. 3.

When lowering the fork F, the hydraulic oil is discharged from the bottom chamber 10*a* of the lift cylinder 10. Thus, the controller S of the present embodiment opens the electromagnetic switch valve 19 first when the hydraulic pump motor 11 and the lift motor 12 are still (when the rotation speed of the pump is zero) (step S10). More specifically, the controller S excites the solenoid of the electromagnetic switch valve 19 and shifts the position to the second position 19*b*. Consequently, the hydraulic oil flows from the lift cylinder 10 to the hydraulic pump motor 11 through the pipe K1 and then returns. That is, in step S10, the controller S opens the electromagnetic switch valve 19 so that the direction in which the hydraulic oil flows is the direction in which the hydraulic oil is allowed to flow from the lift cylinder 10 to the hydraulic pump motor 11. The electromagnetic switch valve 19 of the present embodiment is set to have the maximum open degree that is sufficiently small. This limits the flow rate of the hydraulic oil returning to the hydraulic pump motor 11 through the pipe K1. In other words, a small amount of the hydraulic oil flows. Such a flow rate control of the hydraulic oil performed by the electromagnetic switch valve 19 gradually decreases the pressure difference of the electromagnetic switch valve 19 (pilot check valve 20) between an oil passage located toward the lift cylinder 10 from the electromagnetic switch valve 19 (pilot check valve 20) and an oil passage located toward the hydraulic pump motor 11 from the electromagnetic switch valve 19 (pilot check valve 20). The pressure difference decreases to a predetermined pressure difference or less. More specifically, the oil passage K1 (oil passage K4) includes a first portion between the electromagnetic switch valve 19 (pilot check valve 20) and the lift cylinder 10 and a second portion between the electromagnetic switch valve 19 (pilot check valve 20) and the hydraulic pump motor 11. In the oil passage K1 (oil passage K4), a first pressure difference (second pressure difference) between the first portion and the second portion is gradually decreased to the predetermined pressure difference or less. The maximum open degree of the electromagnetic switch valve 19 is set to be small. Thus, the hydraulic oil does not suddenly stat flowing when the electromagnetic switch valve 19 opens. This reduces the shock that may be felt by an operator.

At the same time as when the electromagnetic switch valve 19 opens, the controller S starts a timer used for measuring elapsed time (step S20). Then, the controller S determines whether or not the timer, which was started in step S20, has reached a predetermined time X (step S30). The time X is set to be short enough so that the operator does not feel a time lag from when the operator instructs a lowering operation to when the lowering operation actually starts. The time X of the present embodiment is set to be a fixed value defined in a range "from 0.1 to 0.5 seconds". Additionally, the time X is set so that the pressure difference of the oil passage located toward the lift cylinder 10 from each of the electromagnetic switch valve 19 and the pilot check valve 20 and the oil passage located toward the hydraulic pump motor 11 from each of the electromagnetic switch valve 19 and the pilot check valve 20 is the predetermined pressure difference or less. The predetermined pressure difference or less only needs to be a pressure difference in which an operator of the lifting device (in the present embodiment, forklift) does not feel a shock. The controller S repeats the process of step S30 when a determination result of step S30 is NO.

When the determination result of step S30 is YES, the controller S opens the electromagnetic switch valve 22 (step S40). More specifically, the controller S excites the solenoid of the electromagnetic switch valve 22 and shifts the position to the second position 22*b*. The pilot check valve 20 freely opens when the hydraulic oil flows from the main pipe K, such as during the lifting operation. The pilot check valve 20 blocks the flow of the hydraulic oil from the bottom chamber 10*a*, such as during the lowering operation. In this case, the application of the predetermined pilot pressure opens the pilot check valve 20.

Thus, when the controller S opens the electromagnetic switch valve 22, the hydraulic oil between the bottom chamber 10*a* and the pilot check valve 20 sequentially flows to the spring chamber 20*c* and the electromagnetic switch valve 22 through the throttle oil passage 20*b* formed in the valve body 20*a* of the pilot check valve 20. Then, the hydraulic oil returns to the main pipe K (hydraulic pump motor 11) through the pipe K5. A pressure drop may occur in the pilot check valve 20 when the hydraulic oil passes through the throttle oil passage 20*b*. Such a pressure drop generates a pressure difference between an oil passage located toward the lift cylinder 10 from the throttle oil passage 20*b*, which serves as an inflow side of the throttle oil passage 20*b*, and an oil passage located toward the spring chamber 20*c* from the throttle oil passage 20*b*, which serves as an outflow side of the throttle oil passage 20*b*. More specifically, the pressure of the oil passage located toward the spring chamber 20*c* becomes lower than the pressure of the oil passage located toward the lift cylinder 10. Thus, the pressure difference (second pressure difference) generated between the inflow side and the outflow side of the throttle oil passage 20*b* causes the valve body 20*a* to gradually open. Consequently, the hydraulic oil discharged from the bottom chamber 10*a* of the lift cylinder 10 directly flows to the main pipe K through the pipe K4.

If the diameter (minimum diameter) of the small diameter oil passage 20*e*, which forms the throttle oil passage 20*b*, is too large relative to the maximum open degree of the electromagnetic switch valve 22, the pressure difference would not be generated between the inflow side and the outflow side of the throttle oil passage 20*b*. Thus, the valve body 20*a* would not open. If the diameter (minimum diameter) of the small diameter oil passage 20*e* is too small, the pressure difference would be too large between the inflow side and the outflow side of the throttle oil passage 20*b*. Thus, the valve body 20*a* would quickly open. Thus, the diameter (minimum diameter) of the small diameter oil passage 20*e* is set to generate a pressure difference that opens the valve body 20*a* and to be suitable for the open degree of the electromagnetic switch valve 22.

At a timing when the pilot check valve 20 starts to open, the controller S controls the rotation speeds of the hydraulic pump motor 11 and the lift motor 12 so that the operation is performed at the speed instructed in accordance with the operation amount of the lift lever L.

In such a control, when opening the pilot check valve 20, which has the large maximum open degree, the pressure difference has been decreased by opening the electromagnetic switch valve 19, which has the small maximum open degree. This limits generation of a shock caused by a sudden flow of the hydraulic oil when the pilot check valve 20 opens, that is, degreases a shock that may occur when the hydraulic oil flows due to the pressure difference between the oil passage located toward the lift cylinder 10 from the electromagnetic switch valve 19 (pilot check valve 20) and the oil passage located toward the hydraulic pump motor 11 from the electromagnetic switch valve 19 (pilot check valve 20).

Then, the hydraulic oil discharged from the bottom chamber 10*a* of the lift cylinder 10 is drawn through the main pipe K into the transmission opening 11*a* of the hydraulic pump motor 11. In this case, the transmission opening 11*a* functions as the inlet. The hydraulic pump motor 11 uses the hydraulic oil discharged from the bottom chamber 10*a* as driving power and operates as the hydraulic motor. Consequently, the lift motor 12 functions as the electric generator. Power generated with the lift motor 12 is stored in the battery BT via the inverter S1. More specifically, a regeneration operation is performed when lowering the fork F. The hydraulic oil, which serves as the driving power of the hydraulic pump motor 11, flows from the lift cylinder 10 to the hydraulic pump motor 11 through the oil passages, that is, the pipe K1 and the pipe K4, when the electromagnetic switch valve 19 and the pilot check valve 20 open, respectively.

Accordingly, the present embodiment has the advantages described below.

(1) During the lowering operation, the electromagnetic switch valve 19, which has the small maximum open degree, opens first. This opens the oil passage between the lift cylinder 10 and the hydraulic pump motor 11. Since the electromagnetic switch valve 19 has the small maximum open degree, the flow rate of the hydraulic oil flowing to the oil passage is limited. Thus, the hydraulic oil does not suddenly start flowing. Additionally, the opening of the electromagnetic switch valve 19 decreases the pressure difference between the lift cylinder 10 and the hydraulic pump motor 11. After the oil passage opens between the lift cylinder 10 and the hydraulic pump motor 11, the pilot check valve 20 having the large maximum open degree may open. In this case, if a predetermined condition is satisfied, the pressure difference has been already decreased. This limits the generation of a shock even when the hydraulic oil suddenly flows, thereby decreasing a shock that may occur when lowering the lifting material.

(2) Additionally, when the lowering operation starts, the control for the lifting operation is not performed on the hydraulic pump motor 11. This minimizes the time lag from when a lowering operation is instructed to when the lowering operation is actually performed. Consequently, the lifting material may be promptly operated.

(3) During the lowering operation, the regeneration operation is performed by using the hydraulic oil discharged from the lift cylinder 10 as the driving power that drives the hydraulic pump motor 11 as the hydraulic motor. Thus, electric energy may be efficiently used. In the present embodiment, the maximum open degree of the pilot check valve 20 is set to be sufficiently large. Thus, the pressure drop is small when the hydraulic oil passes through the pilot check valve 20. This provides a sufficient torque used for rotating the hydraulic pump motor 11 as the hydraulic motor. Consequently, electric energy may be efficiently obtained from the regeneration operation.

(4) The difference in the maximum open degree between the electromagnetic switch valve 19 and the pilot check valve 20 is set to be large. This promptly operates the fork F while decreasing a shock that may occur when lowering the lifting material by controlling the timing for opening the electromagnetic switch valve 19 and the pilot check valve 20 without proportionally controlling open degrees of the valves.

(5) The valve open degree of an electromagnetic proportional valve may be proportionally controlled. When such an electromagnetic proportional valve is employed, the pressure difference may be decreased by adjusting the open degree of the electromagnetic proportional valve without using the electromagnetic switch valve 19, the pilot check valve 20, and the electromagnetic switch valve 22. That is, a shock that may occur during the lowering operation would be decreased. However, an electromagnetic proportional valve is expensive. Additionally, a current amplifier is needed to drive a proportional valve when an electromagnetic proportional valve is employed. Thus, the overall cost would increase. Moreover, the hydraulic control mechanism would be enlarged. Thus, the present embodiment, which uses no electromagnetic proportional valve, limits an increase in costs.

(6) In particular, when a regeneration operation is performed during the lowering operation, the regeneration is more efficient when an on-off valve (electromagnetic switch valve 19) is employed than when an electromagnetic proportional valve is employed. Thus, the structure of the present embodiment may increase the efficiency of the regeneration operation while reducing a shock.

(7) The timing for opening the pilot check valve 20 is time-managed. This eliminates a need for various kinds of sensors, which are needed when the timing for opening the valve is managed using pressure, flow rate, or the like. Thus, the structure and control may be simplified.

(8) The electromagnetic switch valve 22 is used to control the opening of the pilot check valve 20. More specifically, the electromagnetic switch valve 22 is the means for applying the pilot pressure to the pilot check valve 20. This limits an enlargement of the device and an increase in costs compared to when an electromagnetic switch valve having a large maximum open degree is employed instead of the pilot check valve 20. Additionally, there is no need to set the electromagnetic switch valve 22 to have a large maximum open degree. This reduces consumption of power needed for controlling the opening of the valve.

Second Embodiment

Figure 4:
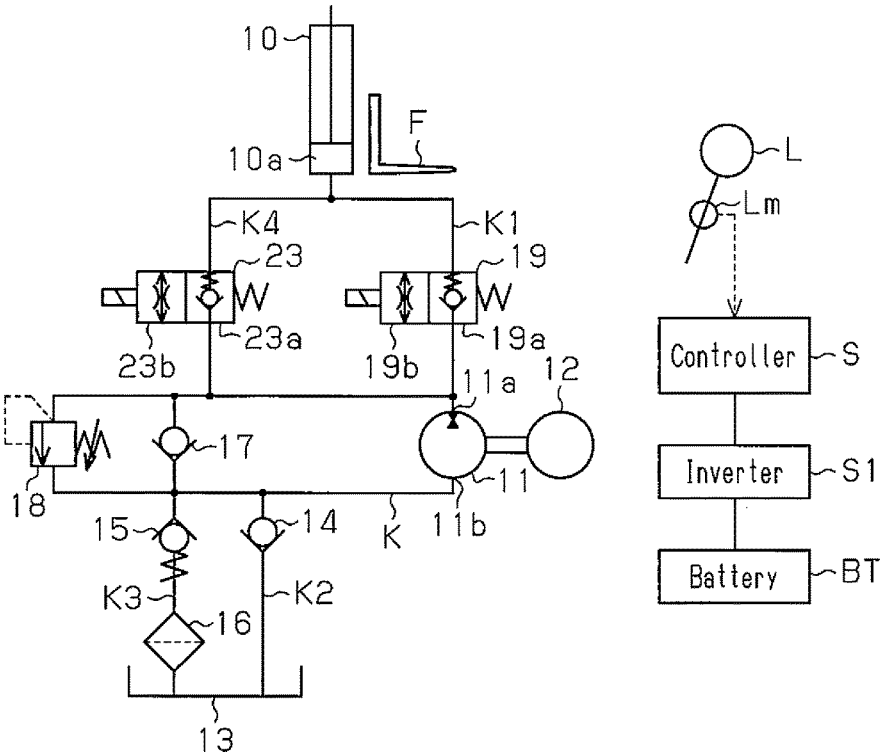
FIG. 4 is a circuit diagram of a second embodiment of a lifting device.

A second embodiment of the present invention will now be described with reference to FIG. 4. In the embodiment described below, the same reference symbols are given to those components having the same structure as the embodiment that has been described. Such components will not be described in detail.

The hydraulic control mechanism of the present embodiment includes the pipe K4 serving as the second oil passage, which is arranged separately from the pipe K1 and forms the passage through which the hydraulic oil is supplied to and discharged from the lift cylinder 10. The pipe K4 includes an electromagnetic switch valve 23, which serves as the second direction control valve that switches a flow direction of the hydraulic oil in the second oil passage. When a solenoid is not excited, the electromagnetic switch valve 23 of the present embodiment is set at a first position 23*a* and allows the hydraulic oil to flow from the hydraulic pump motor 11 to the lift cylinder 10. When the solenoid is excited, the electromagnetic switch valve 23 of the present embodiment is set at a second position 23*b* and allows the hydraulic oil to bidirectionally flow between the hydraulic pump motor 11 and the lift cylinder 10. The electromagnetic switch valve 23 of the present embodiment is an on-off valve, which adjusts an open degree in accordance with the excitement (on) and non-excitement (off) of the solenoid. Thus, the electromagnetic switch valve 23 of the present embodiment differs from an electromagnetic proportional valve capable of adjusting the open degree in a non-stepped manner. The electromagnetic switch valve 23 of the present embodiment forms the opening-closing unit that opens and closes the pipe K4, which serves as the second oil passage.

In the present embodiment, the maximum open degrees of the electromagnetic switch valve 19 and the electromagnetic switch valve 23 are each set as described below. The open degree of the electromagnetic switch valve 23 becomes maximal when set at the second position 23*b*. In the present embodiment, the maximum open degree of the electromagnetic switch valve 23 is set to be larger than the maximum open degree of the electromagnetic switch valve 19. In other words, the maximum open degree of the electromagnetic switch valve 19 is set to be smaller than the maximum open degree of the electromagnetic switch valve 23. More specifically, the ratio of the maximum open degree of the electromagnetic switch valve 19 to the maximum open degree of the electromagnetic switch valve 23 is set to be in a range of 1:20 to 1:50. That is, the maximum open degree of the electromagnetic switch valve 23 is set to be in a range of 20 to 50 times larger than the maximum open degree of the electromagnetic switch valve 19. In the hydraulic control mechanism of the present embodiment, the maximum open degree of the electromagnetic switch valve 19 corresponds to the maximum oil passage area of the first oil passage. The maximum open degree of the electromagnetic switch valve 23 corresponds to the maximum oil passage area of the second oil passage.

The operation of the hydraulic control mechanism of the present embodiment will now be described.

The operation of the hydraulic control mechanism of the present embodiment differs from the first embodiment in the control of the electromagnetic switch valve 23. The contents of the control of the electromagnetic switch valve 19 are the same as the first embodiment. The controller S of the present embodiment also functions as the opening-closing unit that opens and closes the first oil passage and the second oil passage.

The operation for lifting the fork F will now be described.

The controller S controls the rotation speeds of the hydraulic pump motor 11 and the lift motor 12 so that the fork F is lifted at a speed that is in accordance with the operation amount instructed with the lift lever L. The controller S also sets the electromagnetic switch valves 19, 23 at the first positions 19*a*, 23*a*, respectively. Thus, the hydraulic oil, which is drawn from the oil tank 13 by the hydraulic pump motor 11, flows through the main pipe K to each of the electromagnetic switch valves 19, 23 and then the bottom chamber 10*a*. That is, the direction in which the hydraulic oil flows is the direction in which the hydraulic oil flows from the oil tank 13 to each of the electromagnetic switch valves 19, 23 and then from each of the electromagnetic switch valves 19, 23 to the bottom chamber 10*a* of the lift cylinder 10. When the hydraulic oil enters the bottom chamber 10*a*, the lift cylinder 10 is extended. This lifts the fork F.

The operation for lowering the fork F will now be described.

Figure 3:
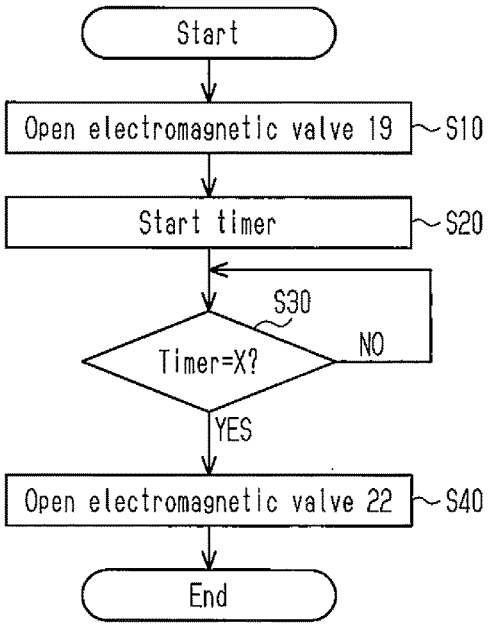
FIG. 3 is a flowchart showing the procedures of operations.

The controller S opens the electromagnetic switch valve 19 first when the hydraulic pump motor 11 and the lift motor 12 are still (when the rotation speed of the pump is zero) (step S10 of FIG. 3). At the same time as when the electromagnetic switch valve 19 opens, the controller S starts the timer used for measuring elapsed time (step S20 of FIG. 3).

When the timer reaches the predetermined time X (determined YES in step S30 of FIG. 3), the controller S opens the electromagnetic switch valve 23. More specifically, the controller S excites the solenoid of the electromagnetic switch valve 23 and shifts the position to the second position 23*b*. Consequently, the hydraulic oil flows from the lift cylinder 10 to the hydraulic pump motor 11 through the pipe K1 and returns. That is, the controller S opens the electromagnetic switch valve 23 so that the direction in which the hydraulic oil flows is the direction in which the hydraulic oil is allowed to flow from the lift cylinder 10 to the hydraulic pump motor 11. Additionally, at a timing when the electromagnetic switch valve 23 opens, the controller S controls the rotation speeds of the hydraulic pump motor 11 and the lift motor 12 so that the operation is performed at the speed instructed in accordance with the operation amount of the lift lever L.

In the same manner as the first embodiment, in such a control, when opening the electromagnetic switch valve 23, which has the large maximum open degree, the pressure difference has been decreased by opening the electromagnetic switch valve 19, which has the small maximum open degree. This limits generation of a shock caused by a sudden flow of the hydraulic oil when the electromagnetic switch valve 23 opens, that is, decreases a shock that may occur when the hydraulic oil flows due to the pressure difference between the oil passage located toward the lift cylinder 10 from the electromagnetic switch valve 19 and the oil passage located toward the hydraulic pump motor 11 from the electromagnetic switch valve 19.

Then, the hydraulic oil discharged from the bottom chamber 10*a* of the lift cylinder 10 is drawn through the main pipe K into the transmission opening 11*a* of the hydraulic pump motor 11. Thus, the hydraulic pump motor 11 operates as the hydraulic motor. Consequently, the regeneration operation is performed when lowering the fork F. The hydraulic oil, which serves as the driving power of the hydraulic pump motor 11, flows from the lift cylinder 10 to the hydraulic pump motor 11 through the oil passages, that is, the pipe K1 and the pipe K4, when the electromagnetic switch valve 19 and the electromagnetic switch valve 23 respectively open.

The present embodiment has advantages (1) to (7) of the first embodiment. In the advantages of the present embodiment, the "pilot check valve 20" and the "electromagnetic switch valve 22" in advantages (1) to (7) of the first embodiment are replaced by the "electromagnetic switch valve 23".

Third Embodiment

Figure 5:
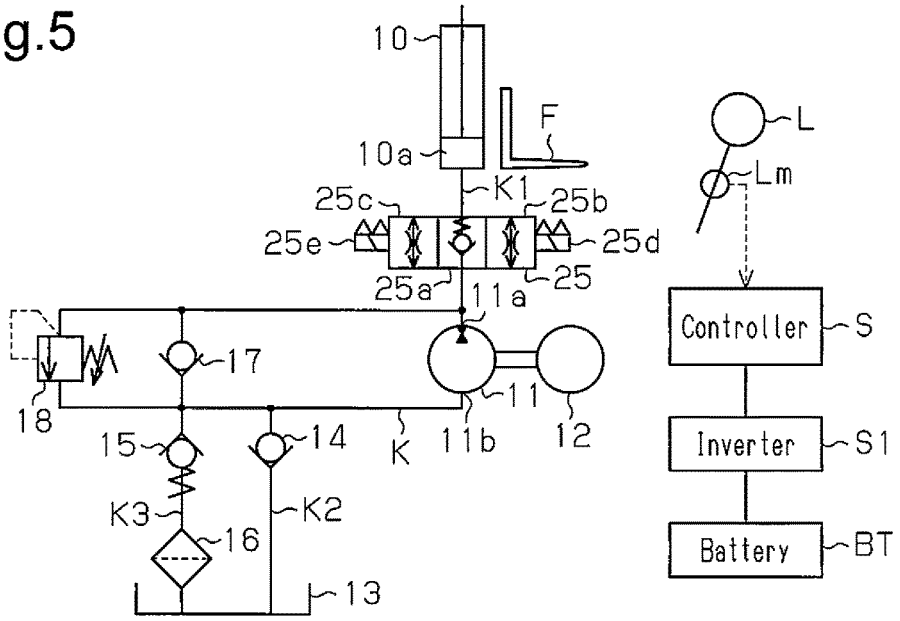
FIG. 5 is a circuit diagram of a third embodiment of a lifting device.

A third embodiment of the present invention will now be described with reference to FIG. 5.

In the hydraulic control mechanism of the present embodiment, an electromagnetic switch valve 25 is arranged in the pipe K1, which connects the bottom chamber 10*a* of the lift cylinder 10 and the hydraulic pump motor 11. The electromagnetic switch valve 25 may be shifted between three positions, namely, a first position 25*a*, a second position 25*b*, and a third position 25*c*. When neither a first solenoid 25*d* nor a second solenoid 25*e* is excited, the electromagnetic switch valve 25 of the present embodiment is set at the first position 25*a* and allows the hydraulic oil to flow from the hydraulic pump motor 11 to the lift cylinder 10. When the first solenoid 25*d* is excited, the electromagnetic switch valve 25 of the present embodiment is set at the second position 25*b* and allows the hydraulic oil to bidirectionally flow between the hydraulic pump motor 11 and the lift cylinder 10. When the second solenoid 25*e* is excited, the electromagnetic switch valve 25 of the present embodiment is set at the third position 25*c* and allows the hydraulic oil to bidirectionally flow between the hydraulic pump motor 11 and the lift cylinder 10. The electromagnetic switch valve 25 of the present embodiment is an on-off valve, which adjusts an open degree in accordance with the excitement (on) and non-excitement (off) of the solenoid. Thus, the electromagnetic switch valve 25 of the present embodiment differs from an electromagnetic proportional valve capable of adjusting the open degree in a non-stepped manner.

Further, the electromagnetic switch valve 25 of the present embodiment has different maximum open degrees between the second position 25*b* and the third position 25*c*. More specifically, the maximum open degree of the third position 25*c* is set to be larger than the maximum open degree of the second position 25*b*. In other words, the maximum open degree of the second position 25*b* is set to be smaller than the maximum open degree of the third position 25*c*. The ratio of the maximum open degree of the second position 25*b* to the maximum open degree of the third position 25*c* is set to be in a range of 1:20 to 1:50. That is, the maximum open degree of the third position 25*c* is set to be in a range of 20 to 50 times larger than the maximum open degree of the second position 25*b*. The relationship of the maximum open degree of the second position 25*b* and the maximum open degree of the third position 25*c* is the same as the relationship of the maximum open degrees of the electromagnetic switch valve 19 and the electromagnetic switch valve 22 of the first embodiment and the relationship of the maximum open degrees of the electromagnetic switch valve 19 and the electromagnetic switch valve 23 of the second embodiment.

The hydraulic control mechanism of the present embodiment includes a first oil passage and a second oil passage. The first oil passage is formed by the pipe K1 and connects the lift cylinder 10 and the hydraulic pump motor 11 via the electromagnetic switch valve 25 when set at the second position 25*b*. The second oil passage is formed by the pipe K1 and connects the lift cylinder 10 and the hydraulic pump motor 11 via the electromagnetic switch valve 25 when set at the third position 25*c*. In the electromagnetic switch valve 25 of the hydraulic control mechanism of the present embodiment, the maximum open degree of the second position 25*b* is smaller than that of the third position 25*c*. Thus, when configured in the above manner, the maximum oil passage area of the first oil passage is smaller than the maximum oil passage area of the second oil passage. The electromagnetic switch valve 25 forms an opening-closing unit that opens and closes each of the first oil passage and the second oil passage. The electromagnetic switch valve 25 of the present embodiment serves as the first direction control valve when set at the second position 25*b*, and serves as the second direction control valve when set at the third position 25*c*. Thus, the electromagnetic switch valve 25 includes both the first direction control valve and the second direction control valve.

The operation of the hydraulic control mechanism of the present embodiment will now be described.

The operation of the hydraulic control mechanism of the present embodiment differs from the first and second embodiments in that the electromagnetic switch valve 25 is controlled. The controller S of the present embodiment also functions as the opening-closing unit that opens and closes the first oil passage and the second oil passage.

The operation for lifting the fork F will now be described.

The controller S controls the rotation speeds of the hydraulic pump motor 11 and the lift motor 12 so that the fork F is lifted at a speed that is in accordance with the operation amount instructed with the lift lever L. The controller S also sets the electromagnetic switch valve 25 at the first position 25*a*. Thus, the hydraulic oil, which is drawn from the oil tank 13 by the hydraulic pump motor 11, flows through the main pipe K to the electromagnetic switch valve 25 and then to the bottom chamber 10*a*. That is, the direction in which the hydraulic oil flows is the direction in which the hydraulic oil flows from the oil tank 13 to the electromagnetic switch valve 25 and then from the electromagnetic switch valve 25 to the bottom chamber 10*a* of the lift cylinder 10. When the hydraulic oil enters the bottom chamber 10*a*, the lift cylinder 10 is extended. This lifts the fork F.

The operation for lowering the fork F will now be described.

The controller S opens the electromagnetic switch valve 25 at the second position 25*b* when the hydraulic pump motor 11 and the lift motor 12 are still (when the rotation speed of the pump is zero). At the same time as when the electromagnetic switch valve 25 opens at the second position 25*b*, the controller S starts the timer used for measuring the elapsed time. When the timer reaches the predetermined time X, the controller S shifts the electromagnetic switch valve 25 from the second position 25*b* to the third position 25*c*. Thus, the electromagnetic switch valve 25 opens at the third position 25*c*. In the hydraulic control mechanism of the present embodiment, the hydraulic oil flows from the lift cylinder 10 to the hydraulic pump motor 11 through the pipe K1 and one of the second position 25*b* and the third position 25*c* of the electromagnetic switch valve 25. This returns the hydraulic oil to the hydraulic pump motor 11. That is, the controller S opens the electromagnetic switch valve 25 at one of the second position 25*b* and the third position 25*c* so that the direction in which the hydraulic oil flows is the direction in which the hydraulic oil is allowed to flow from the lift cylinder 10 to the hydraulic pump motor 11. Additionally, at a timing when the electromagnetic switch valve 25 opens at the third position 25*c*, the controller S controls the rotation speeds of the hydraulic pump motor 11 and the lift motor 12 so that the operation is performed at the speed instructed in accordance with the operation amount of the lift lever L.

In the same manner as the first and second embodiments, in such a control, when opening the electromagnetic switch valve 25 at the third position 25*c*, which has the large maximum open degree, the pressure difference has been decreased by opening the electromagnetic switch valve 25 at the second position 25*b*, which has the small maximum open degree. This limits generation of a shock caused by a sudden flow of the hydraulic oil when the electromagnetic switch valve 25 opens at the third position 25*c*, that is, decreases a shock that may occur when the hydraulic oil flows due to the pressure difference between the oil passage located toward the lift cylinder 10 from the electromagnetic switch valve 25 and the oil passage located toward the hydraulic pump motor 11 from the electromagnetic switch valve 25.

Then, the hydraulic oil discharged from the bottom chamber 10*a* of the lift cylinder 10 is drawn through the main pipe K into the transmission opening 11*a* of the hydraulic pump motor 11. Thus, the hydraulic pump motor 11 operates as the hydraulic motor. Consequently, the regeneration operation is performed when lowering the fork F. The hydraulic oil, which serves as the driving power of the hydraulic pump motor 11, flows from the lift cylinder 10 to the hydraulic pump motor 11 through the pipe K1 when the electromagnetic switch valve 25 opens.

The present embodiment has the advantages described below in addition to advantages (1) to (7) of the first embodiment. In the advantages of the present embodiment, the "electromagnetic switch valve 19" and the "pilot check valve 20" in advantages (1) to (7) of the first embodiment are replaced by the "electromagnetic switch valve 25".

(9) The pipe K1 includes the electromagnetic switch valve 25 capable of opening at the second position 25*b* and the third position 25*c*, which have different maximum open degrees. More specifically, the single electromagnetic switch valve 25 is arranged in the oil passage connecting the lift cylinder 10 and the hydraulic pump motor 11 to control the amount of the hydraulic oil flowing through the pipe K1. This simplifies the hydraulic control mechanism. Use of the single electromagnetic switch valve 25 also simplifies the piping connecting the lift cylinder 10 and the hydraulic pump motor 11.

Fourth Embodiment

Figure 6:
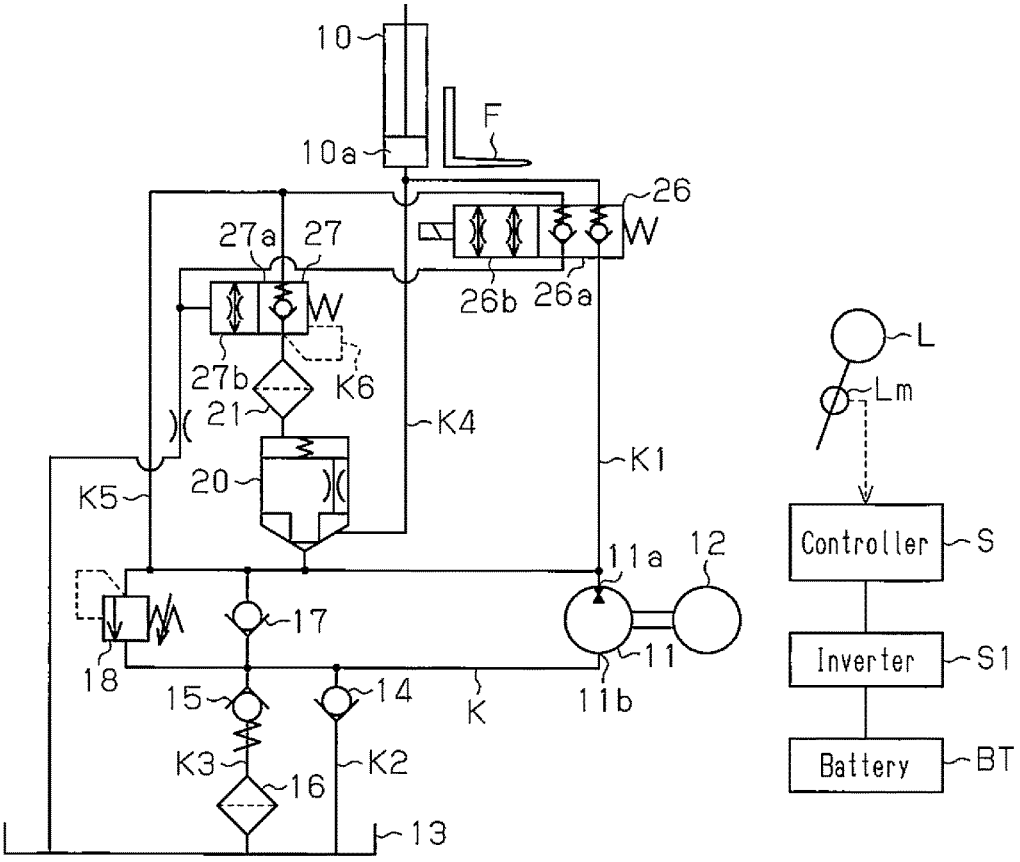
FIG. 6 is a circuit diagram of a fourth embodiment of a lifting device.

A fourth embodiment of the present invention will now be described with reference to FIG. 6.

The hydraulic control mechanism of the present embodiment includes an electromagnetic switch valve 26 arranged in the pipe K1, which connects the bottom chamber 10*a* of the lift cylinder 10 and the hydraulic pump motor 11. The electromagnetic switch valve 26 serves as the first direction control valve, which switches a flow direction of the hydraulic oil in the first oil passage. The electromagnetic switch valve 26 of the present embodiment is a four-port valve and arranged in the pipe K5, which connects the main pipe K and the oil tank 13, in addition to the pipe K1. The electromagnetic switch valve 26 may be shifted between two positions, namely, a first position 26*a* and a second position 26*b*. When a solenoid is not excited, the electromagnetic switch valve 26 of the present embodiment is set at the first position 26*a* and allows the hydraulic oil to flow in one direction. When the solenoid is excited, the electromagnetic switch valve 26 of the present embodiment is set at the second position 26*b* and allows the hydraulic oil to flow in two directions. The electromagnetic switch valve 26 of the present embodiment is an on-off valve, which adjusts an open degree in accordance with the excitement (on) and non-excitement (off) of the solenoid. Thus, the electromagnetic switch valve 26 of the present embodiment differs from an electromagnetic proportional valve capable of adjusting the open degree in a non-step manner.

Additionally, the hydraulic control mechanism of the present embodiment includes the pilot check valve 20 arranged in the pipe K4, which connects the bottom chamber 10*a* of the lift cylinder 10 and the hydraulic pump motor 11. The spring chamber 20*c* of the pilot check valve 20 is connected to a pressure compensation valve 27, which serves as a switch valve, via the filter 21. The specific configuration of the pilot check valve 20 is as illustrated in the first embodiment with reference to FIG. 2. Thus, the configuration is the same as the first embodiment.

The pressure compensation valve 27 may be shifted between two positions, namely, a first position 27*a* and a second position 27*b*. The pressure compensation valve 27 is connected to the pipe K5 located between the main pipe K and the electromagnetic switch valve 26 and the pipe K5 located between the electromagnetic switch valve 26 and the oil tank 13. The pressure compensation valve 27 is normally set at the first position 27*a*. When the pressure of the pipe K5 increases between the electromagnetic switch valve 26 and the oil tank 13, the pressure compensation valve 27 shifts from the first position 27*a* to the second position 27*b*. When set at the first position 27*a*, the pressure compensation valve 27 allows the hydraulic oil to flow to the pipe K5 located between the main pipe K and the electromagnetic switch valve 26. When set at the second position 27*b*, the pressure compensation valve 27 allows the hydraulic oil to flow in two directions.

In the present embodiment, the maximum open degree of each of the electromagnetic switch valve 26 and the pilot check valve 20 is set as described below. In the description hereafter, the open degree of the electromagnetic switch valve 26 becomes maximal when set at the second position 26*b*. Also, the open degree of the pilot check valve 20 is maximal when the valve body 20*a* is open. In the present embodiment, the maximum open degree of the pilot check valve 20 is set to be larger than the maximum open degree of the electromagnetic switch valve 26. In other words, the maximum open degree of the electromagnetic switch valve 26 is set to be smaller than the maximum open degree of the pilot check valve 20. More specifically, the ratio of the maximum open degree of the electromagnetic switch valve 26 to the maximum open degree of the pilot check valve 20 is set to be in a range of 1:20 to 1:50. That is, the maximum open degree of the pilot check valve 20 is set to be in a range of 20 to 50 times larger than the maximum open degree of the electromagnetic switch valve 26. The relationship of the maximum open degree of the electromagnetic switch valve 26 and the maximum open degree of the pilot check valve 20 is the same as the relationship of the maximum open degrees of the electromagnetic switch valve 19 and the pilot check valve 20 of the first embodiment.

In the hydraulic control mechanism of the present embodiment, the maximum open degree of the electromagnetic switch valve 26 corresponds to the maximum oil passage area of the first oil passage. The maximum open degree of the pilot check valve 20 corresponds to the maximum oil passage area of the second oil passage. Thus, the pipe K1, which includes the electromagnetic switch valve 26 and serves as the first oil passage, has the maximum oil passage area that is smaller than the maximum oil passage area of the pipe K4, which includes the pilot check valve 20 and serves as the second oil passage. In the same manner as the first embodiment, the present embodiment includes the opening-closing unit formed by the electromagnetic switch valve 26, which opens and closes the pipe K1 serving as the first oil passage, the pilot check valve 20, which opens and closes the pipe K4 serving as the second oil passage, and the controller S, which controls the opening and closing.

The operation of the hydraulic control mechanism of the present embodiment will now be described.

The operation for lifting the fork F will now be described.

The controller S controls the rotation speeds of the hydraulic pump motor 11 and the lift motor 12 to perform lifting at a speed that is in accordance with the operation amount instructed with the lift lever L. The controller S also sets the electromagnetic switch valve 26 at the first position 26*a*. Thus, the hydraulic oil, which is drawn from the oil tank 13 by the hydraulic pump motor 11, flows through the main pipe K to the electromagnetic switch valve 26 and then the bottom chamber 10*a*. That is, the direction in which the hydraulic oil flows is the direction in which the hydraulic oil flows from the oil tank 13 to the electromagnetic switch valve 26 and then from the electromagnetic switch valve 26 to the bottom chamber 10*a* of the lift cylinder 10. When the hydraulic oil enters the bottom chamber 10*a*, the lift cylinder 10 is extended. This lifts the fork F.

The operation for lowering the fork F will now be described.

When the hydraulic pump motor 11 and the lift motor 12 are still (when the rotation speed of the pump is zero), the electromagnetic switch valve 26 is set at the first position 26*a*. The hydraulic oil does not flow from the bottom chamber 10*a* of the lift cylinder 10 to the pipe K1. Additionally, the pressure compensation valve 27 is set at the first position 27*a*. This connects the bottom chamber 10*a* of the lift cylinder 10 and a pipe K6 of the pressure compensation valve 27 via the throttle oil passage 20*b*, which includes the small diameter oil passage 20*e* of the pilot check valve 20. Thus, the pressure of the pipe K6 is the same as the pressure of the bottom chamber 10*a*. The pressure of the pipe K6 sets the pressure compensation valve 27 at the first position 27*a*. The hydraulic oil does not flow from the pipe K6 to the pipe K5.

When the lowering operation is instructed, the controller S opens the electromagnetic switch valve 26 at the second position 26*b*. At same time as when the electromagnetic switch valve 26 opens at the second position 26*b*, the controller S starts the timer used for measuring elapsed time. When the electromagnetic switch valve 26 is open at the second position 26*b*, the hydraulic oil of the bottom chamber 10*a* passes through the electromagnetic switch valve 26, the maximum open degree of which is set to be small. This increases the pressure of the oil passage located toward the hydraulic pump motor 11 from the electromagnetic switch valve 26, thereby gradually decreasing the pressure difference at the inflow side and the outflow side of the electromagnetic switch valve 26 set at the second position 26*b*. Consequently, the pressure difference decreases to the predetermined pressure difference or less. The maximum open degree of the electromagnetic switch valve 26 is set to be small. Thus, the hydraulic oil does not suddenly start flowing when the electromagnetic switch valve 26 opens. This reduces a shock that may be felt by an operator.

When the electromagnetic switch valve 26 opens at the second position 26*b*, the pressure of the pipe K1 increases. This increases the pressure of the pipe K5, which is also open via the electromagnetic switch valve 26. The increased pressure of the pipe K5 triggers a shift of the pressure compensation valve 27 from the first position 27*a* to the second position 27*b*. Thus, when the pressure difference between the pipe K5 and the pipe K6 decreases to the fixed value or less, the pressure compensation valve 27 shifts to the second position 27*b*. When the pressure compensation valve 27 shifts to the second position 27*b*, the hydraulic oil flows to the pipe K5 through the throttle oil passage 20*b*, which includes the small diameter oil passage 20*e* of the pilot check valve 20. Then, a pressure drop occurs in the small diameter oil passage 20*e*. This pushes the valve body 20*a* of the pilot check valve 20 in the direction in which the pipe K4 opens. Consequently, the pilot check valve 20 opens. That is, the pressure drop that occurs when the hydraulic oil passes through the throttle oil passage 20*b* generates a pressure difference between the oil passage located toward the lift cylinder 10, which serves as the inflow side of the throttle oil passage 20*b*, and the oil passage located toward the spring chamber 20*c*, which serves as the outflow side of the throttle oil passage 20*b*. More specifically, the pressure of the spring chamber 20*c* is lower than the pressure of the oil passage located toward the lift cylinder 10 from the pilot check valve 20. Thus, the pressure difference generated between the inflow side and the outflow side of the throttle oil passage 20*b* causes the valve body 20*a* to gradually open. Consequently, the hydraulic oil discharged from the bottom chamber 10*a* of the lift cylinder 10 directly flows to the main pipe K through the pipe K4.

When a value measured by the timer reaches a fixed value, the controller S controls the rotation speeds of the hydraulic pump motor 11 and the lift motor 12 to perform lifting at a speed that is in accordance with the operation amount instructed with the lift lever L. In the hydraulic control mechanism of the present embodiment, the time when the pilot check valve 20 opens is calculated in advance through simulations. Then, the fixed value described above is set to be larger than or equal to the calculated value. The fixed value is also the time when the pressure difference between the oil passage located toward the lift cylinder 10 from the pilot check valve 20 and the oil passage located toward the hydraulic pump motor 11 from the pilot check valve 20 decreases to the predetermined pressure difference or less.

In such a control, when opening the pilot check valve 20, which has the large maximum open degree, the pressure difference has been decreased by opening the electromagnetic switch valve 26, which has the small maximum open degree. This limits generation of a shock caused by a sudden flow of the hydraulic oil when the pilot check valve 20 opens, that is, decreases a shock that may occur when the hydraulic oil flows due to the pressure difference between the oil passage located toward the lift cylinder 10 and the oil passage located toward the hydraulic pump motor 11 from the electromagnetic switch valve 26.

Then, the hydraulic oil discharged from the bottom chamber 10*a* of the lift cylinder 10 is drawn through the main pipe K into the transmission opening 11*a* of the hydraulic pump motor 11. In this case, the transmission opening 11*a* functions as the inlet. The hydraulic pump motor 11 uses the hydraulic oil discharged from the bottom chamber 10*a* as driving power and operates as the hydraulic motor. Consequently, the lift motor 12 functions as the electric generator. Power generated with the lift motor 12 is stored in the battery BT via the inverter S1. More specifically, a regeneration operation is performed when lowering the fork F. The hydraulic oil, which serves as the driving power of the hydraulic pump motor 11, flows from the lift cylinder 10 to the hydraulic pump motor 11 through the oil passages, that is, the pipe K1 and the pipe K4, when the electromagnetic switch valve 26 and the pilot check valve 20 respectively open.

The present embodiment has the advantages described below in addition to advantages (1) to (8) of the first embodiment. In the advantages of the present embodiment, the "electromagnetic switch valve 19" and the "electromagnetic switch valve 22" in advantages (1) to (8) of the first embodiment are replaced by the "electromagnetic switch valve 26" and the "pressure compensation valve 27", respectively.

(10) The pressure compensation valve 27 shifts between the first position 27*a* and the second position 27*b* in accordance with the pressure of the pipe K5. The pressure compensation valve 27 controls the opening and closing of the pilot check valve 20. Thus, the electromagnetic switch valve 26 is a single direction control valve the opening and closing of which is controlled by the controller S. This simplifies the hydraulic control mechanism. Also, use of the single electromagnetic switch valve 26 limits an increase in costs of the hydraulic control mechanism.

Each embodiment may be modified as follows.

In the first to the third embodiments, at the same time as when the electromagnetic switch valves 22, 23, 25 open, the hydraulic pump motor 11 and the lift motor 12 may be operated at a speed that is in accordance with the operation amount instructed with the lift lever L.

In the first and the second embodiments, after the electromagnetic switch valve 19 opens, the electromagnetic switch valves 22, 23 may open when a condition is satisfied. The condition includes the flow rate of the hydraulic oil flowing to the hydraulic pump motor 11 and the decrease of the pressure difference between the inflow side and the outflow side of the electromagnetic switch valve 19. In the third embodiment, after the electromagnetic switch valve 25 shifts to the second position 25*b*, the electromagnetic switch valve 25 may shift to the third position 25*c* when a condition is satisfied. The condition includes the flow rate of the hydraulic oil flowing to the hydraulic pump motor 11 and the decrease of the pressure difference between the inflow side and the outflow side of the electromagnetic switch valve 25.

Each of the embodiments may be configured so that the electromagnetic switch valves 19, 22, 23, 25, 26 block the oil passage between the lift cylinder 10 and the hydraulic pump motor 11 when set at the first positions 19*a*, 22*a*, 23*a*, 25*a*, 26*a*.

In the first and the fourth embodiments, the throttle oil passage 20*b* formed in the valve body 20*a* may have any shape and arrangement.

In the first embodiment, the pipe K5 may be connected to the discharge pipe K3 so that the hydraulic oil passing through the electromagnetic switch valve 22 returns to the oil tank 13.

The application of the hydraulic control mechanism of each embodiment is not limited to a forklift. The hydraulic control mechanism may be applied to an apparatus that performs lowering operation under its weight (e.g., hydraulic elevator).

DESCRIPTION OF REFERENCE SYMBOLS

10 lift cylinder
11 hydraulic pump motor
19, 22, 23, 25, 26 electromagnetic switch valve
20 pilot check valve
20*a* valve body
20*b* throttle oil passage

27 pressure compensation valve
F fork
K1, K4, K5 pipe
S controller
X time

The invention claimed is:

1. A lifting device that lifts and lowers a lifting material by supplying and discharging hydraulic oil to and from a hydraulic cylinder, the lifting device comprising:

a hydraulic pump that supplies the hydraulic oil to the hydraulic cylinder;

a first oil passage that connects the hydraulic cylinder and the hydraulic pump;

a second oil passage that connects the hydraulic cylinder and the hydraulic pump; and an opening-closing unit that opens and closes the first oil passage and the second oil passage, wherein the first oil passage has a maximum oil passage area that is smaller than a maximum oil passage area of the second oil passage, the first oil passage includes a first portion between the hydraulic cylinder and the opening-closing unit, and a second portion between the opening-closing unit and the hydraulic pump, and the opening-closing unit allows the hydraulic oil to flow through the first oil passage when the lifting material is lowered, and after the first oil passage opens, allows the hydraulic oil to flow through the second oil passage when a first pressure difference between the first portion and the second portion decreases to a predetermined pressure difference or less, wherein the opening-closing unit includes a first direction control valve arranged in the first oil passage, wherein the first direction control valve switches a flow direction of the hydraulic oil in the first oil passage, and a second direction control valve arranged in the second oil passage, wherein the second direction control valve switches a flow direction of the hydraulic oil in the second oil passage, the maximum oil passage area of the first oil passage is determined by a maximum open degree of the first direction control valve, the maximum oil passage area of the second oil passage is determined by a maximum open degree of the second direction control valve, and the maximum open degree of the first direction control valve is smaller than the maximum open degree of the second direction control valve.

2. The lifting device according to claim 1, wherein the hydraulic oil flows from the hydraulic cylinder toward the hydraulic pump through the first and second oil passages when the first direction control valve and the second direction control valve open, thereby causing the hydraulic oil to function as driving power used for driving the hydraulic pump as a hydraulic motor so that the hydraulic motor performs a regeneration operation.

3. The lifting device according to claim 1, wherein the maximum open degree of the second direction control valve is set to be in a range of 20 to 50 times larger than the maximum open degree of the first direction control valve.

4. The lifting device according to claim 1, further comprising a measurement unit that measures a time elapsed from when the first direction control valve opens, wherein the opening-closing unit opens the second direction control valve when the elapsed time reaches a predetermined time.

5. The lifting device according to claim 1, further comprising:

a third oil passage through which the hydraulic oil that has passed through the second direction control valve flows; and a switch valve arranged in the third oil passage, wherein the first direction control valve is an electromagnetic switch valve, the second direction control valve is a pilot check valve including a valve body accommodated in the second direction control valve and a throttle oil passage formed in the valve body, the opening-closing unit is configured to open the switch valve, when the switch valve opens, the hydraulic oil is discharged from the hydraulic cylinder to the third oil passage through the throttle oil passage, which generates a second pressure difference between an inflow side and an outflow side of the throttle oil passage, and the valve body moves in a direction in which the second oil passage opens in accordance with the second pressure difference.

6. The lifting device according to claim 5, wherein the switch valve is set to have a maximum open degree that is smaller than the maximum open degree of the pilot check valve, and larger than or equal to the maximum open degree of the first direction control valve.

* * * * *